US012018842B1

(12) United States Patent
Luk et al.

(10) Patent No.: US 12,018,842 B1
(45) Date of Patent: Jun. 25, 2024

(54) STOVE WITH SELF-AIR DRAWING AND HEATING FOR PRIMARY BURN

(71) Applicant: Knowledge Makers LLC, Jamesville, NY (US)

(72) Inventors: Liya W. F. Luk, Jamesville, NY (US); Yan-Yeung Luk, Jamesville, NY (US)

(73) Assignee: Knowledge Makers LLC, Jamesville, NY (US)

( * ) Notice: Subject to any disclaimer, the term of this patent is extended or adjusted under 35 U.S.C. 154(b) by 0 days.

(21) Appl. No.: 18/106,835

(22) Filed: Feb. 7, 2023

(51) Int. Cl.
*F24C 15/12* (2006.01)
*F24C 1/00* (2006.01)
*F24C 15/00* (2006.01)

(52) U.S. Cl.
CPC ..... *F24C 15/006* (2013.01); *F24C 1/00* (2013.01); *F24C 15/12* (2013.01)

(58) Field of Classification Search
CPC ..... F24C 15/006; F24C 1/00; F24C 15/12
See application file for complete search history.

(56) References Cited

U.S. PATENT DOCUMENTS 8,641,413 B2 * 2/2014 Chen ..... F23C 7/02 431/300
2014/0290643 A1 * 10/2014 Potter ..... F23C 7/004 431/126
2015/0167964 A1 * 6/2015 Chen ..... F23D 3/20 431/353
2016/0356491 A1 * 12/2016 Rivera ..... F23D 14/84
2019/0137107 A1 * 5/2019 Crosen ..... F24B 1/181

* cited by examiner

*Primary Examiner* — Alfred Basichas
(74) *Attorney, Agent, or Firm* — Jong Patent Firm; Cheng Ning Jong; Tracy P. Jong

(57) ABSTRACT

A stove including spiraling walls to create multiple vertical inlets, spiraling layers of spaces that can self-draw and self-heat the air from outside of the stove into the burn zone, and a rim that covers the top area of the spiraling walls and leaves an opening above the fire. From burning, a convection draft draws air from the side-environment of the stove through the vertical inlets to circulate in the spiraling layered space, and to supply to the fire horizontally. The circling of air will be heated by the fire through conduction and irradiation. This design enables extra heated air directly for an enhanced primary burn. The stove can include side walls of different profiles, e.g., straight, tilted and curved walls and different spiraling profiles of spiraling layered spaces, e.g., linear, exponential, and exponential-polynomial.

20 Claims, 19 Drawing Sheets

STOVE WITH SELF-AIR DRAWING AND HEATING FOR PRIMARY BURN

BACKGROUND OF THE INVENTION

1. The Field of the Invention

The present invention relates to a stove. More specifically, the present invention is directed to a stove configured to self-draw and heat intake air to enable complete combustion of fuels and to reduce smoke production.

2. Background Art

Combustions produced by conventional stoves are characterized by incomplete combustion or burn, low heat output, low combustion temperature, high heat loss to surroundings especially laterally, high soot production and high overall combustion inefficiency. In a conventional stove, high combustion temperatures are only available when highly insulating materials are used to prevent heat loss through the lateral periphery of the stove. Such approach however requires a mechanism to supply forced air to maintain combustion as highly insulating materials are used to prevent heat loss, which results in limiting the amount of air flow to sustain combustion. Further, in conventional stoves, the air supply useful for sustaining combustion is not pre-heated before reaching the combustion, therefore does not aid the combustion to occur at a high temperature that can cause a more complete combustion which will increase heat production and reduce smoke production.

There exists a need for a stove suitable to cause complete fuel combustion, to produce high heat output and to reduce smoke/soot.

SUMMARY OF THE INVENTION

In accordance with the present invention, there is provided a stove including:

(a) at least one spiral wall configured to wind outwardly a number of turns to form an opening, the at least one spiral wall configured to be disposed in an arrangement to form at least one starting gap between two successive walls formed of the at least one spiral wall at an outer periphery of the at least one spiral wall, the at least one starting gap continues through a path to an ending gap between two successive walls formed of the at least one spiral wall at the opening; and (b) a cover including an opening, the cover configured to be disposed atop the at least one spiral wall to contain the path, leaving the opening of the cover to match the opening of the at least one spiral wall.

wherein a combustion within the opening of the at least one spiral wall draws air for combustion through the at least one starting gap, the path and the at least one ending gap into the opening of the at least one spiral wall.

In one embodiment, the at least one spiral wall can be constructed from stainless steel, metal, fire refractory material, fireclay refractory material, high alumina refractory material, silica brick, magnesite refractory material, chromite refractory material, zirconia refractory material, insulating material, monolithic refractory material or any combinations thereof. In one embodiment, the number of turns of the at least one spiral wall is at least about two turns. In one embodiment, the at least one spiral wall is a structure disposed in a round shape, a polygonal shape or a dome shape.

In one embodiment, the starting gap further includes a top starting gap and a bottom starting gap and each ending gap further includes a top ending gap and a bottom ending gap, wherein the top starting gap is smaller than the bottom starting gap and the top ending gap is smaller than the bottom ending gap. In one embodiment, the stove further including a base configured to be disposed at the bottom of the at least one spiral wall to further contain the path. In one embodiment, the at least one spiral wall includes a thickness of at least about 1/32 inch. In one embodiment, the path includes a cross-sectional profile having an aspect ratio of about 1/40 to about 1/5. In one embodiment, the at least one spiral wall can be a profile that is a linear profile, an exponential profile, an exponential-polynomial profile or any combinations thereof. In one embodiment, the at least one spiral wall leans inwardly.

In accordance with the present invention, there is further provided a stove including:

(a) at least two spiral walls, a first spiral wall of the at least two spiral walls configured to wind outwardly a number of turns and a second spiral wall of the at least two spiral walls configured to wind outwardly a number of turns to form an opening together, the at least two spiral walls configured to be disposed in an arrangement to form at least two starting gaps each between two successive walls formed of the at least two spiral walls, each of the at least two starting gaps continues through a path to each of at least two ending gaps each between two successive walls formed of the at least two spiral walls; and (b) a cover including an opening, the cover configured to be disposed atop the at least two spiral walls to contain the path, leaving the opening of the cover to match the opening of the at least two spiral walls, wherein a combustion within the opening of the at least two spiral walls draw air for combustion through each starting gap, each path and each ending gap.

In one embodiment, the at least two spiral walls can be constructed from stainless steel, metal, fire refractory material, fireclay refractory material, high alumina refractory material, silica brick, magnesite refractory material, chromite refractory material, zirconia refractory material, insulating material, monolithic refractory material or any combinations thereof. In one embodiment, each of the number of turns of the first spiral and the number of turns of the second spiral is at least about two turns. In one embodiment, the at least two spiral walls can be a structure of a round shape, a polygonal shape or a dome shape. In one embodiment, each starting gap further includes a top starting gap and a bottom starting gap and each ending gap further includes a top ending gap and a bottom ending gap, wherein each top starting gap is smaller than each bottom starting gap and each top ending gap is smaller than each bottom ending gap. In one embodiment, the stove further includes a base configured to be disposed at the bottom of the at least two spiral walls to further contain each of the paths. In one embodiment, each of the at least two spiral walls include a thickness of at least about 1/32 inch. In one embodiment, each of the at least two spiral walls can be a profile that is a linear profile, an exponential profile, an exponential-polynomial profile or any combinations thereof. In one embodiment, the at least one spiral wall leans inwardly. In one embodiment, the path includes a cross-sectional profile having an aspect ratio of about 1/40 to about 1/5.

An object of the present invention is to provide a stove which reduces or eliminates the production of soot in combustion.

Another object of the present invention is to provide a stove which reduces or eliminates the production of soot in wood combustion.

Another object of the present invention is to provide a stove which reduces heat loss to the surroundings while producing combustion at increased temperature and high heat output.

Another object of the present invention is to provide a stove which allows the lighting of combustion to be protected and the combustion to continue without having to alter the stove.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
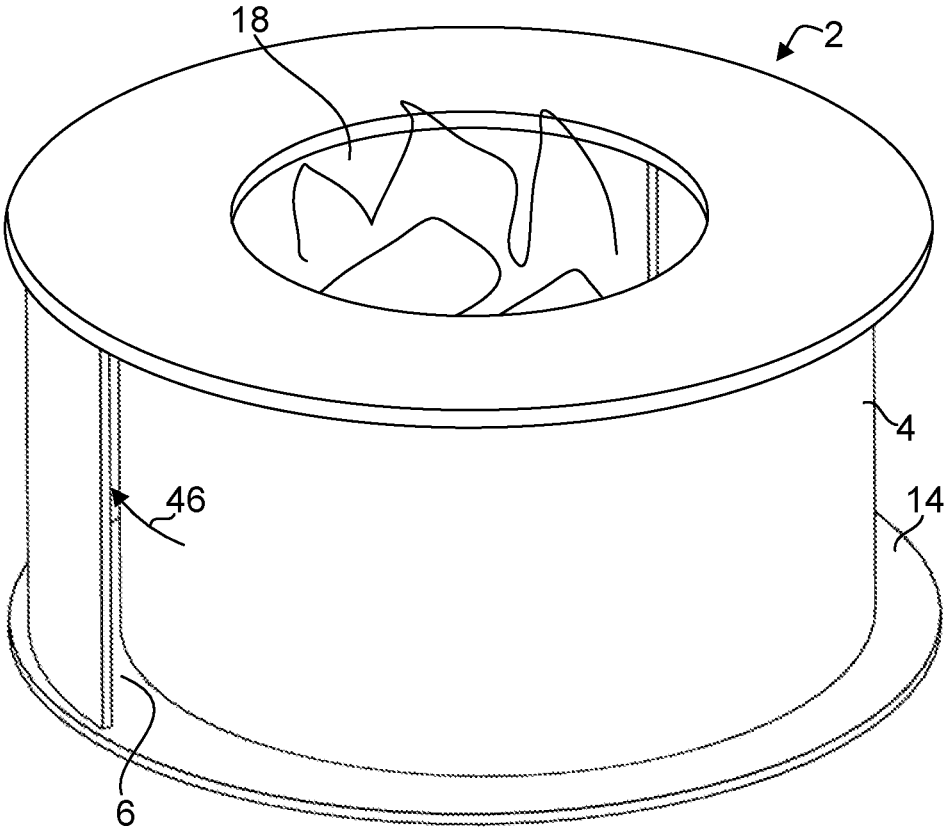
FIG. 1 is a top perspective view of one embodiment of a stove.

2—stove
4—spiral, e.g., wall disposed in a spiral
6—starting gap
8—ending gap
10—cover
12—opening
14—base, e.g., bottom plate
16—fuel, e.g., wood
18—combustion space or opening formed of at least one spiral
20—groove
22—width of stove
24—width of combustion space
26—height of stove
28—thickness of spiral
30—width of gap
32—central axis of stove
34—width of top of gap
36—width of bottom of gap
38—width of spiral
40—incline angle
42—combustion
44—path
46—air flow entering stove
48—air flow exiting path and entering opening
50—slot
52—stand-off Particular Advantages of the Invention The present stove is configured to self-draw and heat air for primary burning to cause complete combustion, to increase heat production and to reduce smoke/soot. In one embodiment, at least two layers constructed of sheet metal, bricks, etc., are used to surround the fire burning within the stove. The space between the two layers is accessible from the surroundings of the stove to allow air intake into the space.

Combustion within the present stove is enhanced with a primary air supply that is already heated to a high temperature. As the self-drawn air supply travels through the space between two walls, e.g., spiraling walls, it is heated in an extended path for an extended amount of time, allowing the air supply to achieve a high temperature prior to entering the opening in which combustion can occur in blue or white flames, signifying high temperature and more complete combustion. As the self-drawn air supply spirals around the burning or combustion zone disposed within the stove before entering the burning zone, a maximum heating effect is achieved by increasing the number of spiral turns of the walls as the dwell time for the air supply to be heated is increased. This self-drawn heated air supply is supplied directly to the fire disposed substantially centrally within the stove and serves as the primary source of oxygen for burning within the stove. As the primary air supply is already hot, the combustion of soot, which otherwise generates smoke, occurs at an early stage and throughout the burning course that would otherwise allow a draft to carry soot away that causes incomplete burn and pollution. This heated primary burning provides a new approach to cause complete combustion of fuel and reduce smoke.

The multiple layers of spiraling air supply also function as an effective insulation to increase the burning temperature of the fire of the stove, reducing heat loss to the surroundings and maintaining high burning temperature. As hot air enters the burning space of the present stove, the horizontal angular moment assists the horizontal movement of the soot, causing additional dwell time of the soot in the burn space for combustion before its escape by convection. By using spiraling walls of exponential or exponential-polynomial profile, the spacing of air intake continuously narrows. When the air supply enters the burning space of the stove through a narrowing path, the air supply transfer speed is increased to cause a more severe turbulence to increase mixing of the fuel with air supply for combustion, enhancing the mixing of air and unburnt fuel (soot) in the gas phase, causing a high temperature and a "clean" burn to be achieved with the combustion. As the present stove achieves high temperature for burning wood, it is suitable for use as an outdoor recreational fire pit, grill, small camp stove, off-grid boiler, garbage burning furnace, cremation furnace, indoor desktop wax-based heating apparatus and others that require high burning temperatures.

Fire ignition can often be affected by wind. Conventional outdoor wood stove requires the air or oxygen transfer from a top opening down into the stove where ignition is applied, which is in the opposite direction of convection when a fire is started. These opposite flows of air often cause the ignition to be difficult. The present stove permits air transfer from the spiraling space from outside to inside of the stove without being disrupted by convection or wind. When a fire is started, a continuous air supply prevents the extinguishing of the fire by either wind or the lack of oxygen.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1A:
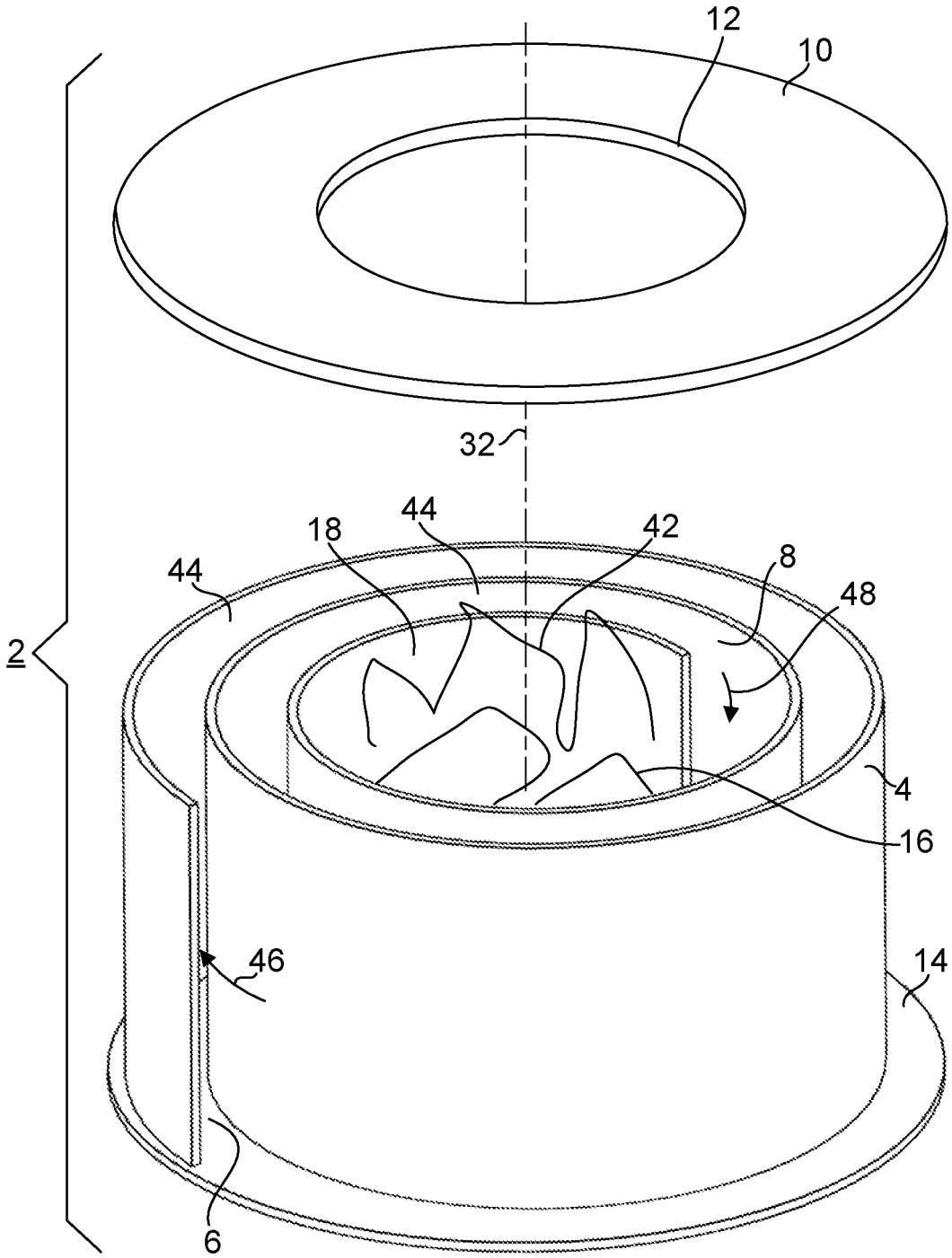
FIG. 1A is a top perspective view of one embodiment of a stove shown with its cover removed to reveal the interior structure of the stove.
Figure 2:
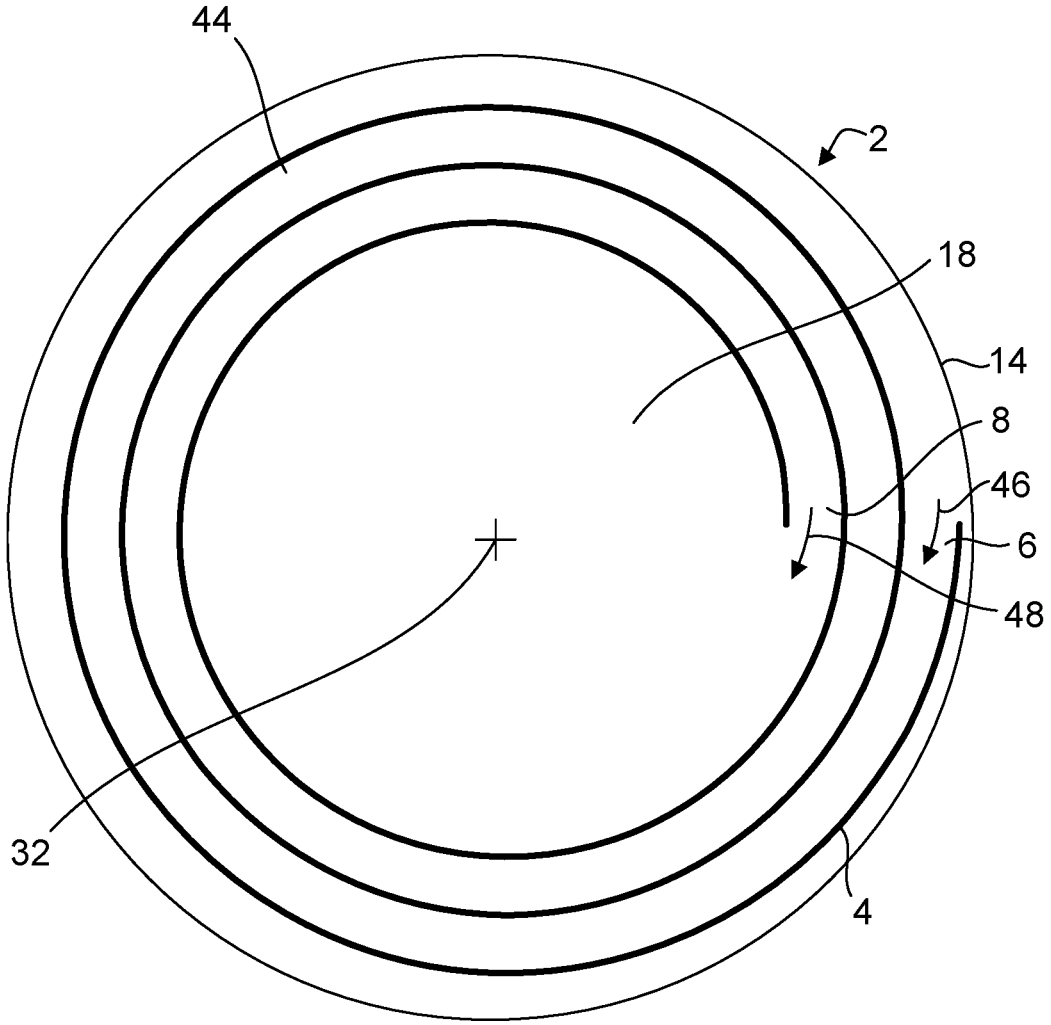
FIG. 2 is a top view of the stove shown in FIG. 1.

FIG. 1 is a top perspective view of one embodiment of a stove 2. FIG. 1A is a top perspective view of one embodiment of a stove 2 shown with its cover removed to reveal the interior structure of the stove 2. In this and any ensuing figures disclosed elsewhere herein where the interior structure of a stove is shown, the interior structure of a stove is visible as its cover and/or base are removed. FIG. 2 is a top view of the stove 2 shown in FIG. 1. The stove 2 includes at least one spiral wall 4 and a cover 10. The spiral wall 4 is configured to wind outwardly a number of turns from within the stove 2 to an outer periphery of the spiral wall 4 to form an opening 18 for combustion 42 to take place, e.g., with multiple solid fuels 16, e.g., wood, pellet or coal, as well as liquid fuels. The spiral wall 4 is configured to be disposed in an arrangement to form a starting gap 6 between two successive walls 4 formed of the spiral wall 4 at the outer periphery of the spiral wall 4. The starting gap 6 continues through a path 44 to an ending gap 8 between two successive walls 4 formed of the spiral wall 4 at the opening 18. The cover 10 includes an opening 12 and it is configured to be disposed atop the spiral wall 4 to contain the path, leaving the opening 12 of the cover 10 to match the opening 18 of the spiral wall 4. Although it is conceivable to dispose the cover 10 to be simply supported on the spiral wall 4, the cover 10 is preferably more securely attached or supported, e.g., by welding or by applying tongue-and-groove techniques to the top edge of the spiral 4 and the bottom surface of the cover 10, leaving no or minimal space for convections to occur over top edges of the spiral 4. A combustion 42 within the opening 18 of the spiral wall 4 causes air 46 to be drawn automatically for combustion through the starting gap 6, the path 44 and the at least one ending gap 8 into the opening 18 of the spiral wall 4, without the use of external power. The convection from burning 42 creates a negative pressure which continues to self-draw air supply via one or more spiraling paths to enhance primary burn.

Figure 3:
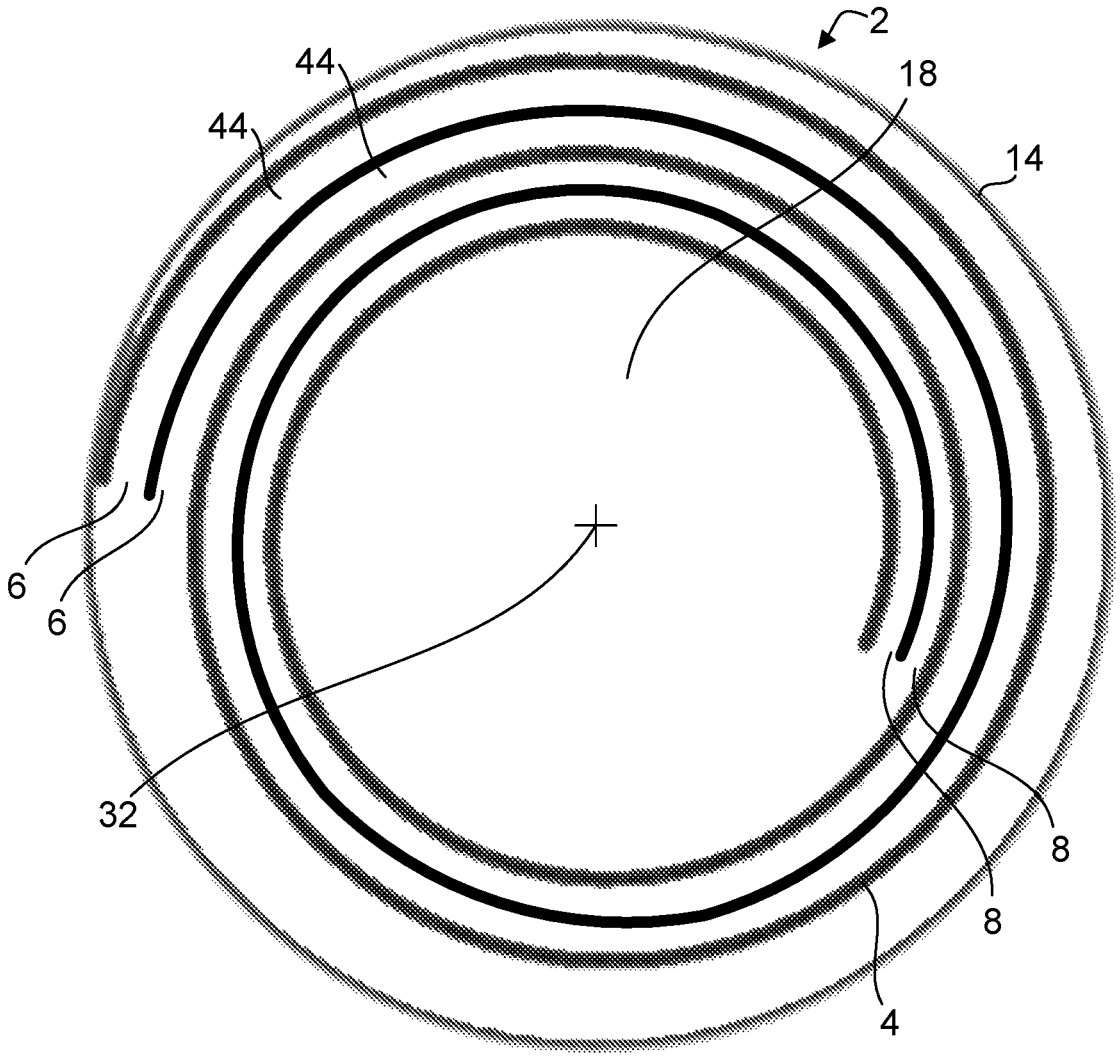
FIG. 3 is a top view of one embodiment of a stove.

FIG. 3 is a top view of one embodiment of a stove 2. Compared to FIG. 1, FIG. 3 depicts a stove 2 including two spirals 4 disposed substantially in parallel with their starting gaps 6 next to one another and their ending gaps 8 next to one another as well. Although the heated air flow or supply 48 exits at substantially the same location, the use of an additional spiral 4 compared to the embodiment shown in FIG. 2 reduces lateral heat loss or heat loss by way of conduction through the spiral walls 4. It is conceivable to use the stove over the ground or another substrate without a base of its own provided that the bottom edges of the spiral 4 are properly sealed to avoid convections under the bottom edges of the spiral 4. However, in the embodiment shown in FIG. 1, the spiral 4 is disposed on a base 14, e.g., a grooved plate where the bottom edges of the spiral 4 serve as the tongues in a tongue-and-groove arrangement with the grooved plate. In one embodiment, the base 14 is not fixedly attached to the spiral 4 to allow disassembly of the spiral 4 from the base 14 for cleaning or for storage. In the embodiment disclosed in FIG. 2 and all other top views disclosed elsewhere herein, the spiral walls are visible as their respective covers have been removed to reveal the contents of the interior arrangements of the stoves.

Figure 4:
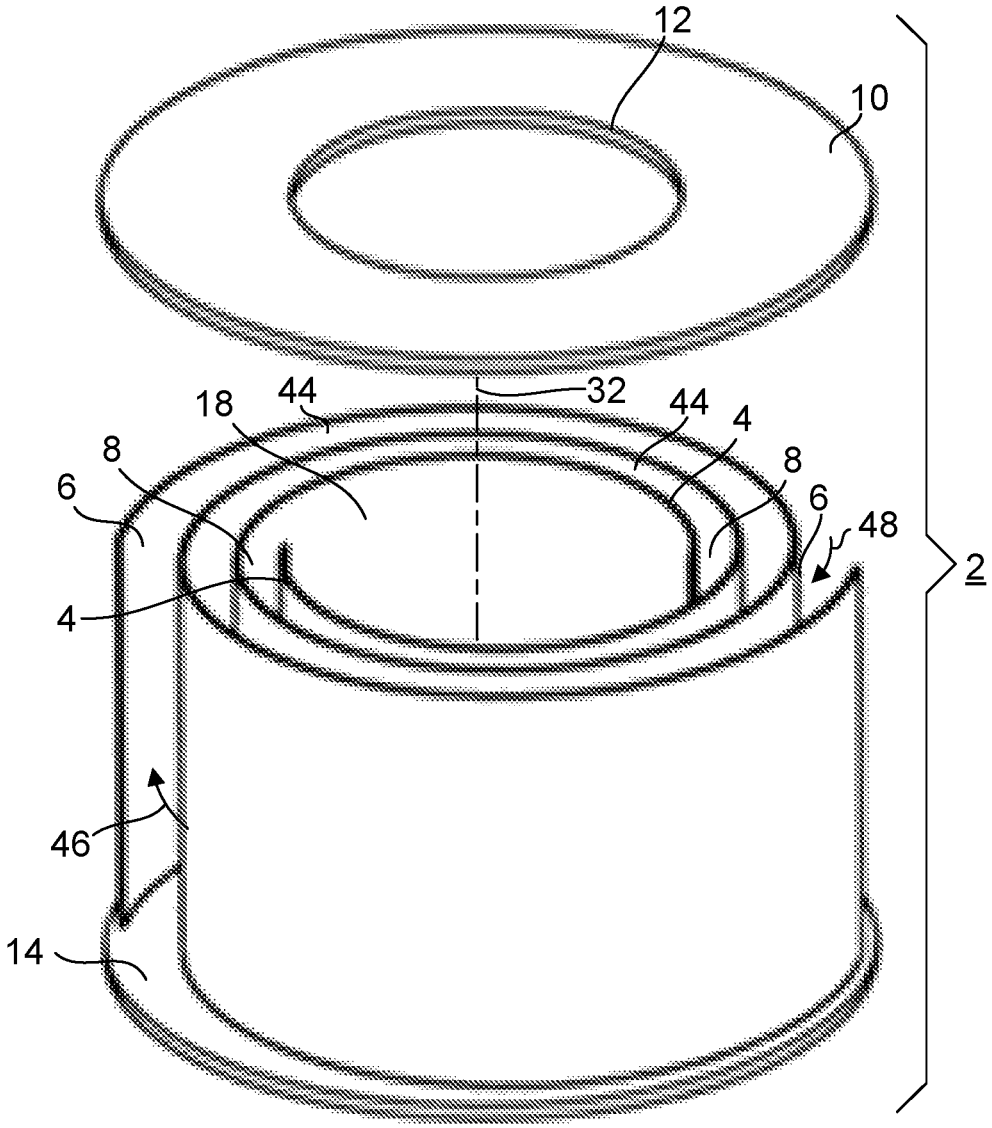
FIG. 4 is a top perspective view of one embodiment of a stove.
Figure 5:
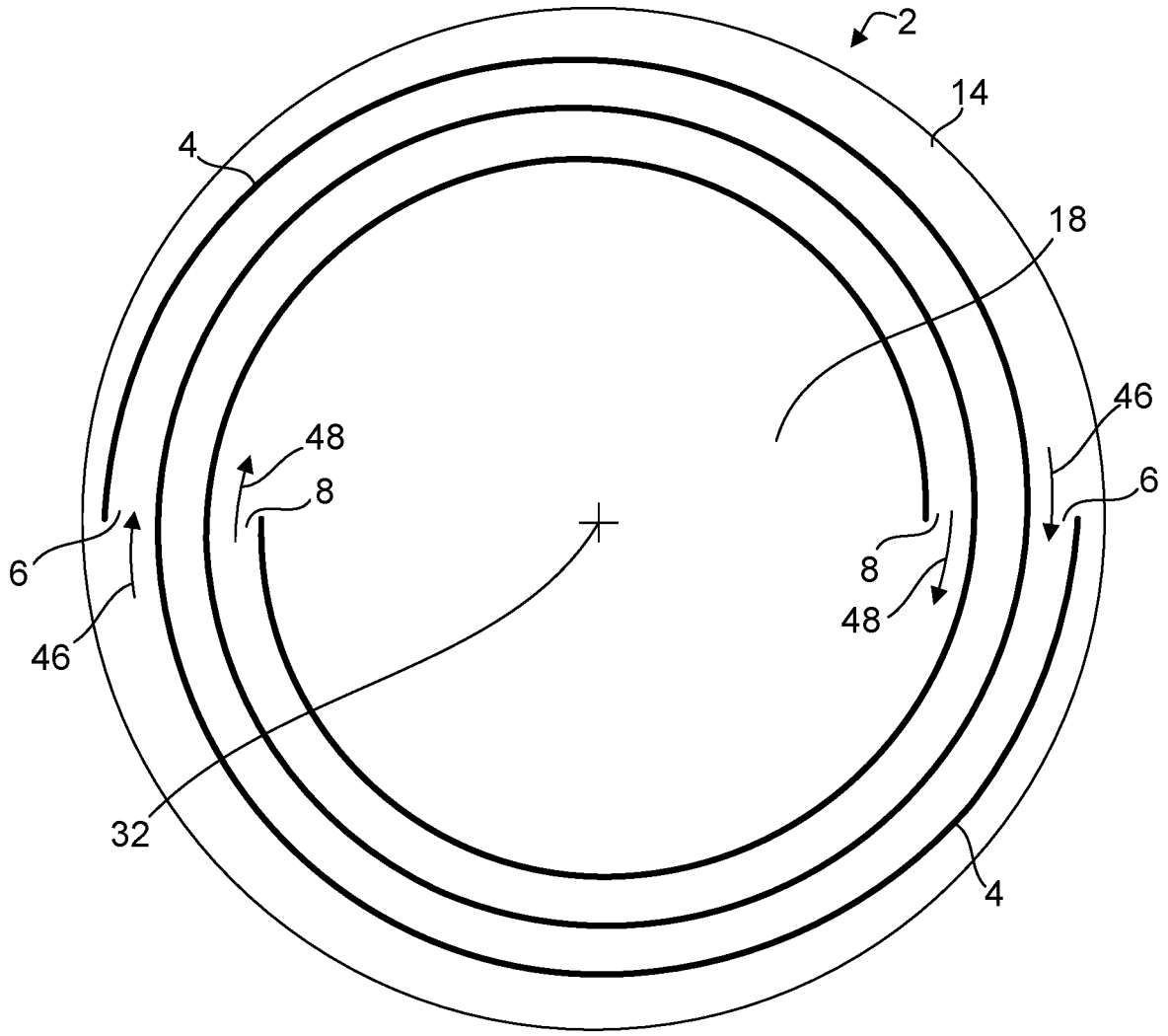
FIG. 5 is a top view of the stove shown in FIG. 4.
Figure 6:
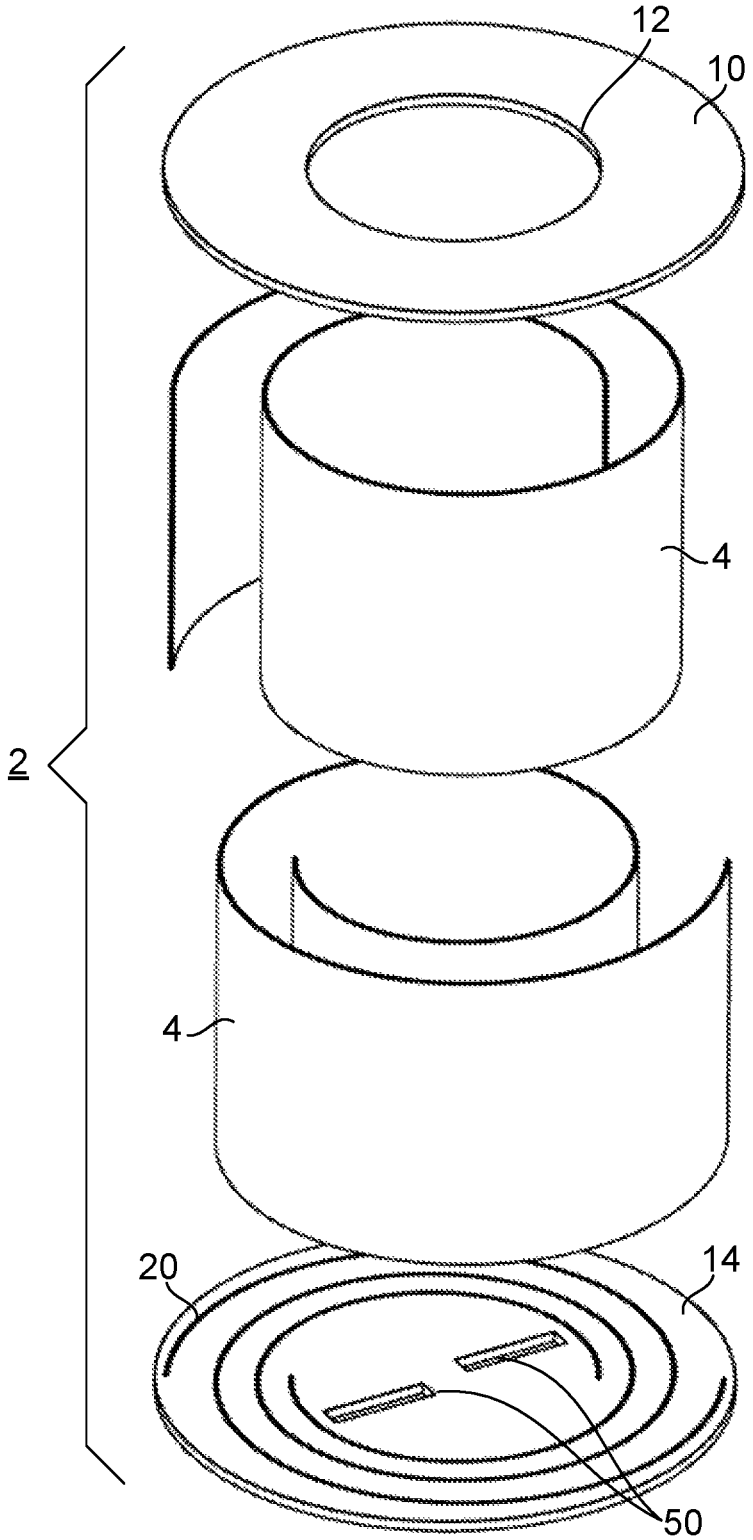
FIG. 6 is an exploded view of the stove shown in FIG. 4.

FIG. 4 is a top perspective view of one embodiment of a stove 2. FIG. 5 is a top view of the stove 2 shown in FIG. 4. FIG. 6 is an exploded view of the stove 2 shown in FIG. 4. The stove 2 includes two spiral walls 4, a first spiral wall 4 configured to wind outwardly a number of turns and a second spiral wall 4 configured to wind outwardly the same number of turns to form an opening 18 together and a cover 10. The two spiral walls 4 are configured to be disposed in an arrangement to form at least two starting gaps substantially opposingly disposed about the central axis 32. Each starting gap 6 is formed between two successive walls 4 formed of the two spiral walls 4. Each starting gap 6 continues through a path 44 to an ending gap 8 formed between two successive walls 4 of the two spiral walls 4. The cover 10 includes an opening 12, wherein the cover 12 is configured to be disposed atop the two spiral walls 4 to contain the path 44, leaving the opening 12 of the cover 10 to match the opening 18 of the two spiral walls 4. A combustion within the opening 18 of the two spiral walls 4 self-draws intake air for combustion through each starting gap 6, each path 44 and each ending gap 8, removing the need for external power to create active air intake flows. Referring to FIG. 6, it shall be noted that, in this embodiment, grooves 20 are provided on the base 14 to facilitate assembly of the spiral walls 4 with the base 14 either loosely or to be welded together if the spiral walls 4 and the base 14 are constructed from like materials suitable to be welded together. In one embodiment, the cover 10 and the base 14 are permanently fixed to the spiral walls 4, rendering the paths 44 not easily accessible where they may be cleaned using compressed air introduced at one of the starting and ending gaps 6, 8. In one embodiment, the number of turns of the spiral wall/s 4 is at least about two turns, i.e., the air intake path 44 winds around at least twice to reduce heat loss through the spiral wall 4 while increasing the air supply temperature to a level significantly higher than a temperature achieved using a secondary burn strategy of conventional stoves. In one embodiment, a present stove has been observed to produce temperatures about 400-500 degrees F. higher than temperatures achieved via a conventional secondary burn strategy. The self-drawn heated air supply is supplied directly to the fire disposed substantially centrally within the stove in the opening 18 and serves as the primary source of oxygen for burning within the stove. As the primary air supply is already heated, the combustion of soot, which otherwise generates smoke, occurs at an early stage during a primary burn process to reduce the amount of smoke generated. In one embodiment, slots 50 are provided on the base 14 to allow drainage of water or ashes collected in the opening 18. During use, the base 14 is disposed on top of the ground or on a non-combustible material, e.g., firebrick, etc., to remove these slots 50 from contributing to combustion.

Figure 7:
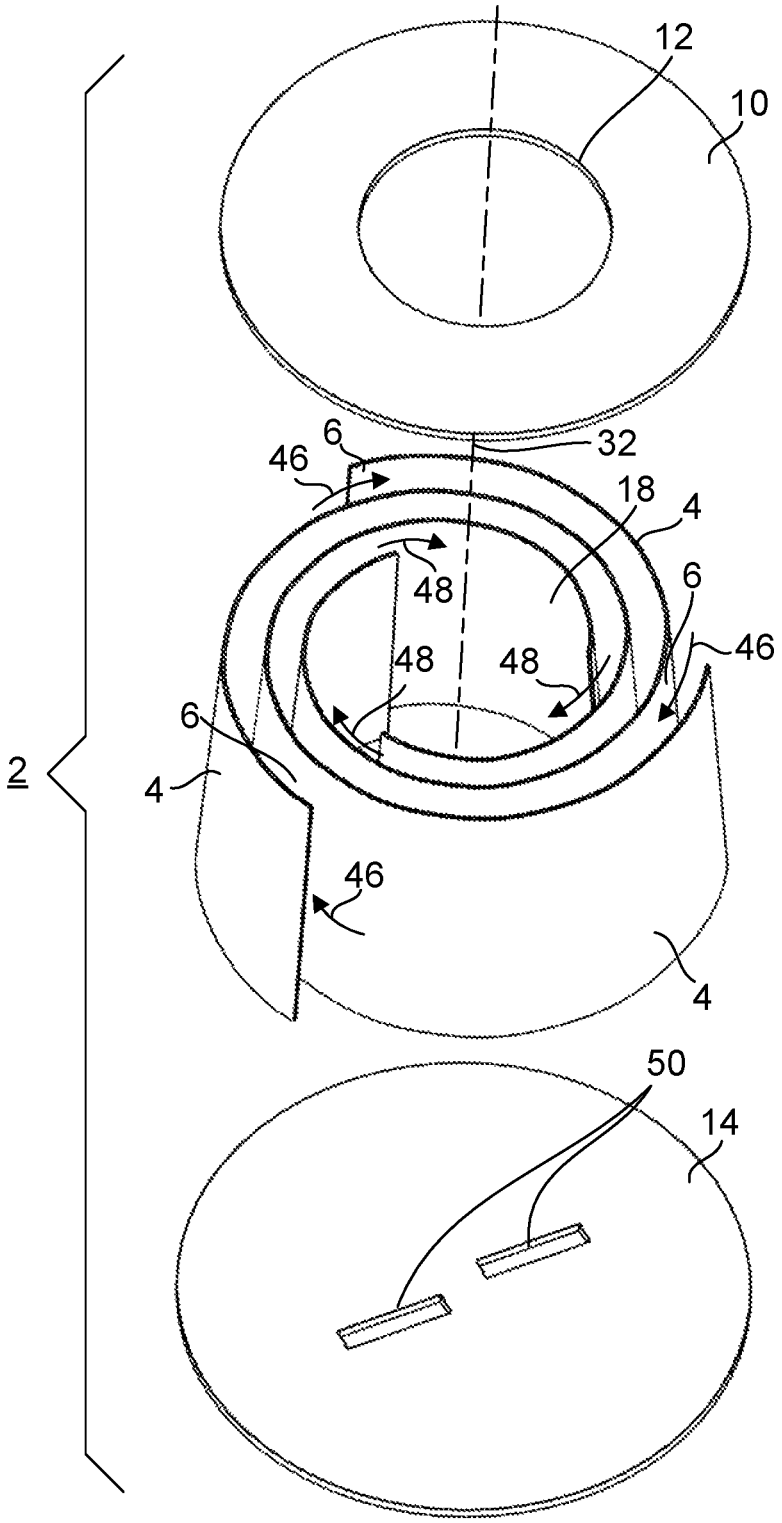
FIG. 7 is an exploded view of one embodiment of a stove.

FIGS. 1-6 depict stoves including one or two spiral walls, where the multiple spiral walls 4 are arranged parallel to one another or arranged symmetrically about a central axis 32. FIG. 7 is an exploded view of one embodiment of a stove 2. The stove 2 includes three spiral walls 4 disposed symmetrically about the central axis 32 of the stove 2, facilitating the intake of air supply to its opening 18 via three symmetrically distributed starting gaps 6. A present stove can be formed with even more spirals 4 although the benefits realized with even more spirals would eventually diminish due to the costs associated with the procurement of a stove with even more parts and one that is more difficult or costly to maintain.

Figure 8:
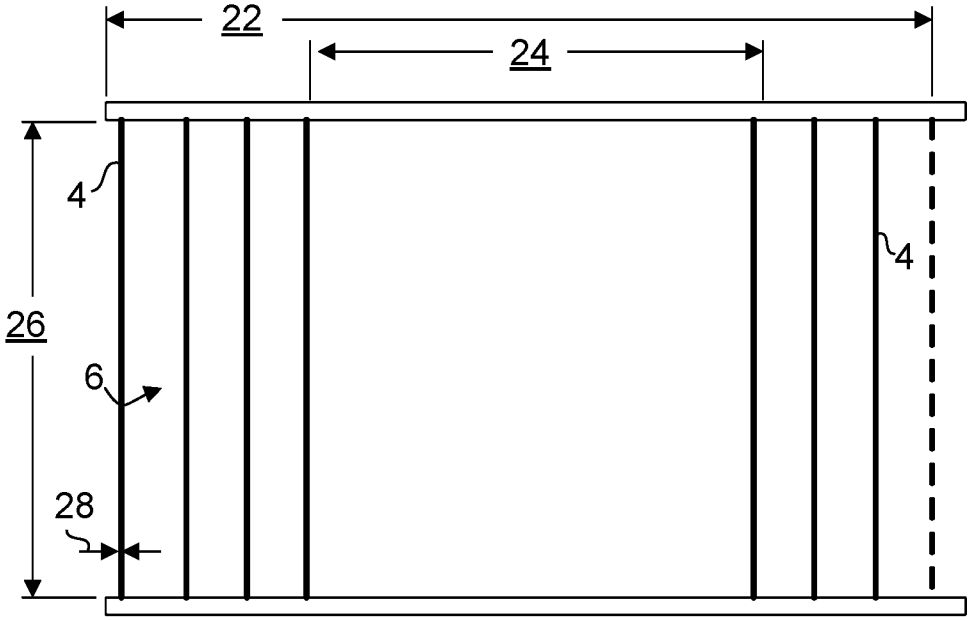
FIG. 8 is a cross-sectional view of the stove shown in FIG. 4, depicting dimensions of the stove.

FIG. 8 is a cross-sectional view of the stove 2 shown in FIG. 4, depicting dimensions of the stove 2. In one embodiment, the width 22 of the stove 2 is about 24 to 30 inches, the width 24 of the combustion space is about 12 to about 18 inches, the height 26 of the stove 2 is about 15 to 20 inches and the thickness 28 of a spiral wall is about 1/32 to 3/16 inch when a metallic material is used, e.g., stainless steel. In one example, a measure of the effectiveness of a present stove is examined. The temperature of the cover or the top rim temperature and the temperature of an outer wall of a spiral or the side temperature are obtained and the ratio of these two values, i.e., top rim temperature/side temperature is calculated. The top rim temperature correlates to the heat output by the stove and the side temperature reveals the heat loss by the stove. Therefore, a higher value of the ratio signifies a more efficient stove. In one embodiment, a present stove is capable of a combustion resulting in an effectiveness ratio of about 9 to 10 compared to a conventional stove having an effectiveness ratio of about 1.5 to 2.5.

Figure 9:
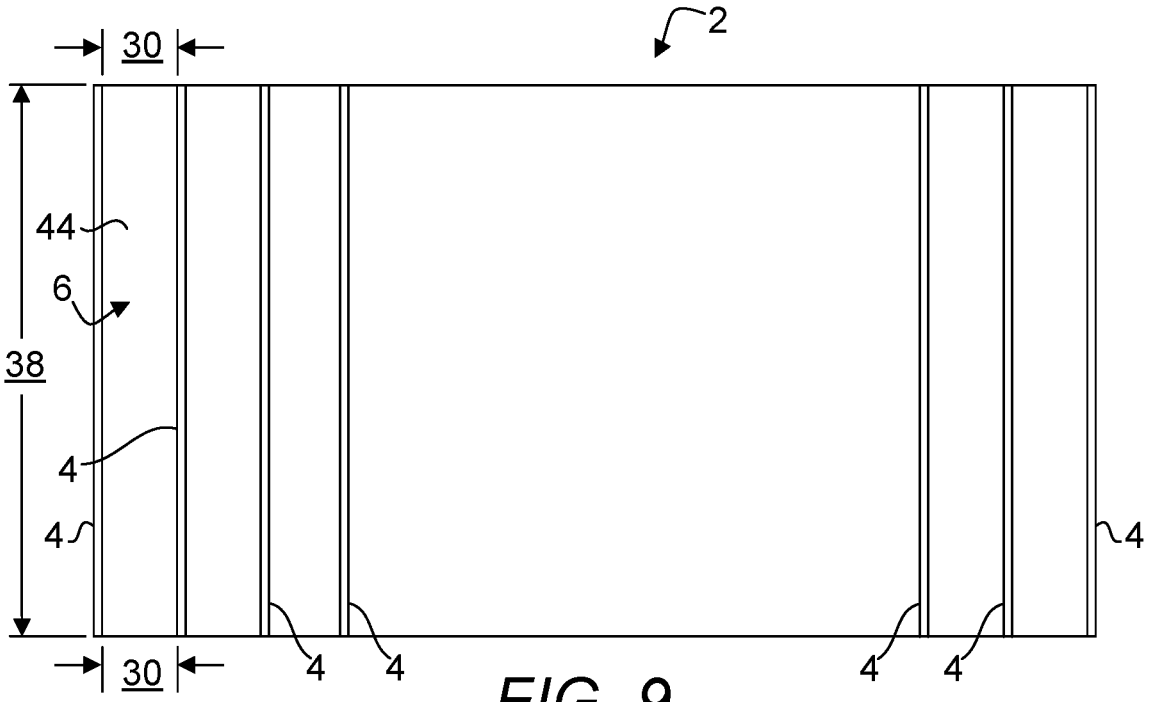
FIG. 9 is a cross-sectional view of the stove of FIG. 4.
Figure 10:
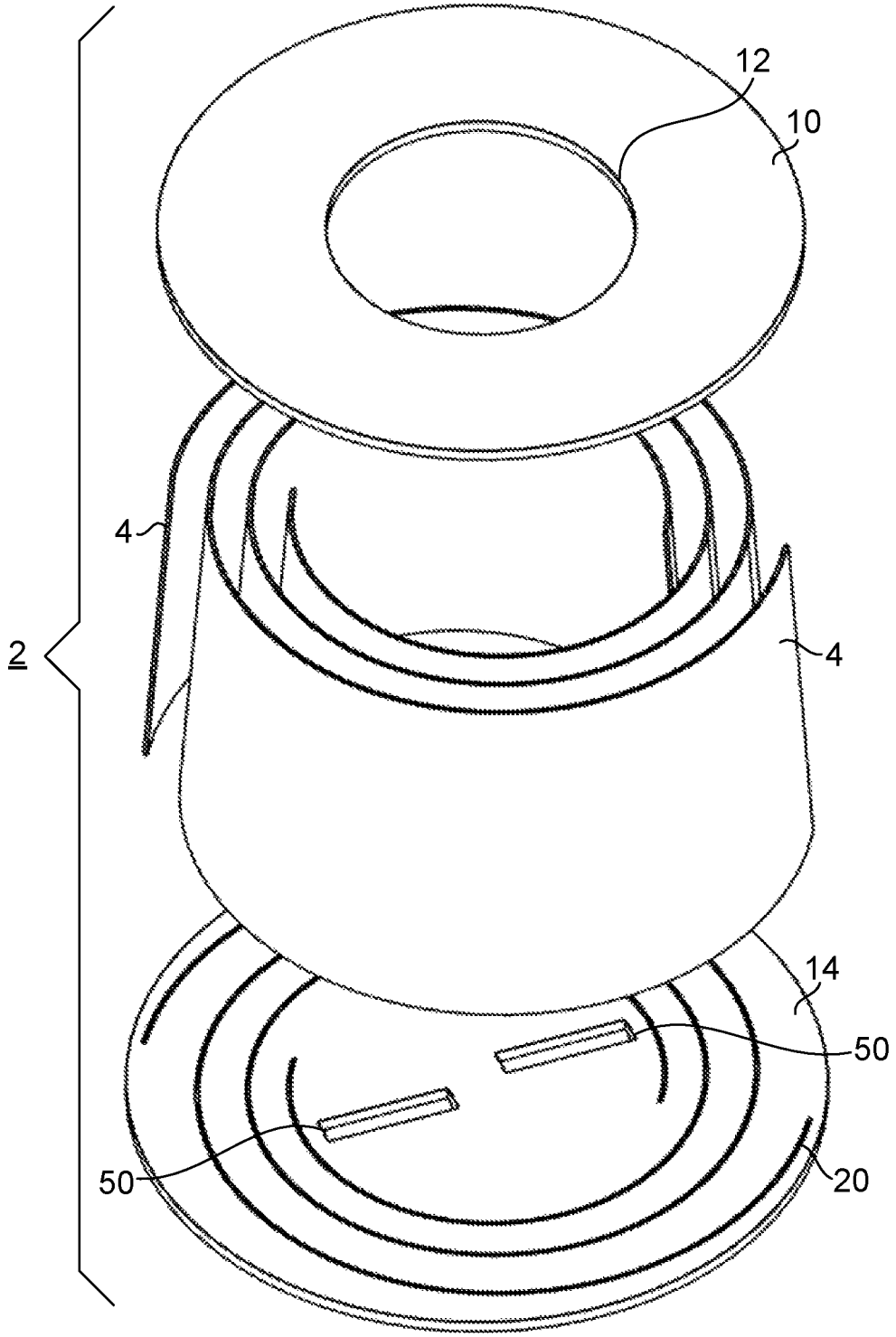
FIG. 10 is a top perspective view of one embodiment of a stove.
Figure 11:
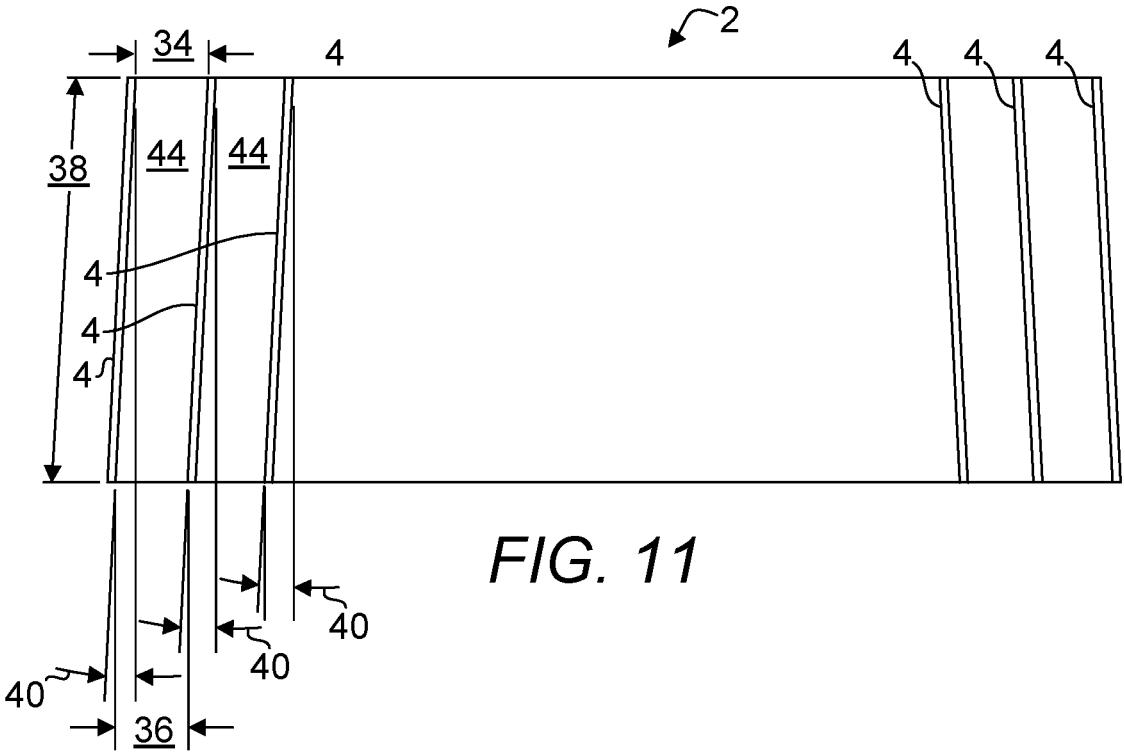
FIG. 11 is a cross-sectional view of the stove of FIG. 10.

FIGS. 9-11 depict two different general cross-sectional profiles of a present stove. FIG. 9 is a cross-sectional view of the stove of FIG. 4 with its cover and base removed. It shall be noted that the path 44 essentially includes a rectangular cross-sectional profile throughout where the width of the path 44 is consistent throughout including the width 30 of the starting gap, i.e., the successive spiral walls 4 are disposed in a vertical manner. In one embodiment, the width of the starting gap 6 is about 1 to 3 inches and the width 38 of a spiral is about 15 to 20 inches. In one embodiment, the path 44 includes a cross-sectional profile having an aspect ratio or the ratio of the width 30 of path 44 to the width 38 of the spiral 4 of about 1/40 to about 1/5. FIG. 10 is a top perspective view of one embodiment of a stove 2. It shall be noted that FIG. 11 depicts a cross-sectional view of the stove 2 of FIG. 10 with its cover and base removed. The successive spiral walls 4 are inclined inwardly at an incline angle 40 of about 5 to about 85 degrees. In the embodiment shown, the incline angles 40 are substantially the same although it is conceivable that each successive pair may lean inwardly at different angles. In the embodiment shown in FIG. 11, although the walls 4 are inclined, the width 34 of the top of the gap remains substantially the same as the width 36 of the bottom of the gap. Here, the cross-sectional profile has an aspect ratio of the width 34, 36 of the path 44 to the width 38 of the spiral 4. A stove 2 including spirals 4 that incline inwardly or of a truncated cone shape has the effect of further reducing heat loss from the opening 18 of the stove 2 due to the narrowing of the opening 18 from the base to the top of the opening 18. In one embodiment not shown, a starting gap further includes a top starting gap disposed in a different width than a bottom starting gap and an ending gap further includes a top ending gap disposed in a different width than a bottom ending gap. In one embodiment, the top starting gap is preferably smaller than the bottom starting gap and the top ending gap is preferably smaller than the bottom ending gap to encourage air supply flows to occur near the bottom portion of the paths in order to supply suitably heated air supply to the bottom portion of the opening to cause more complete combustion, in a primary burn phase near the bottom of the opening.

Figure 12:
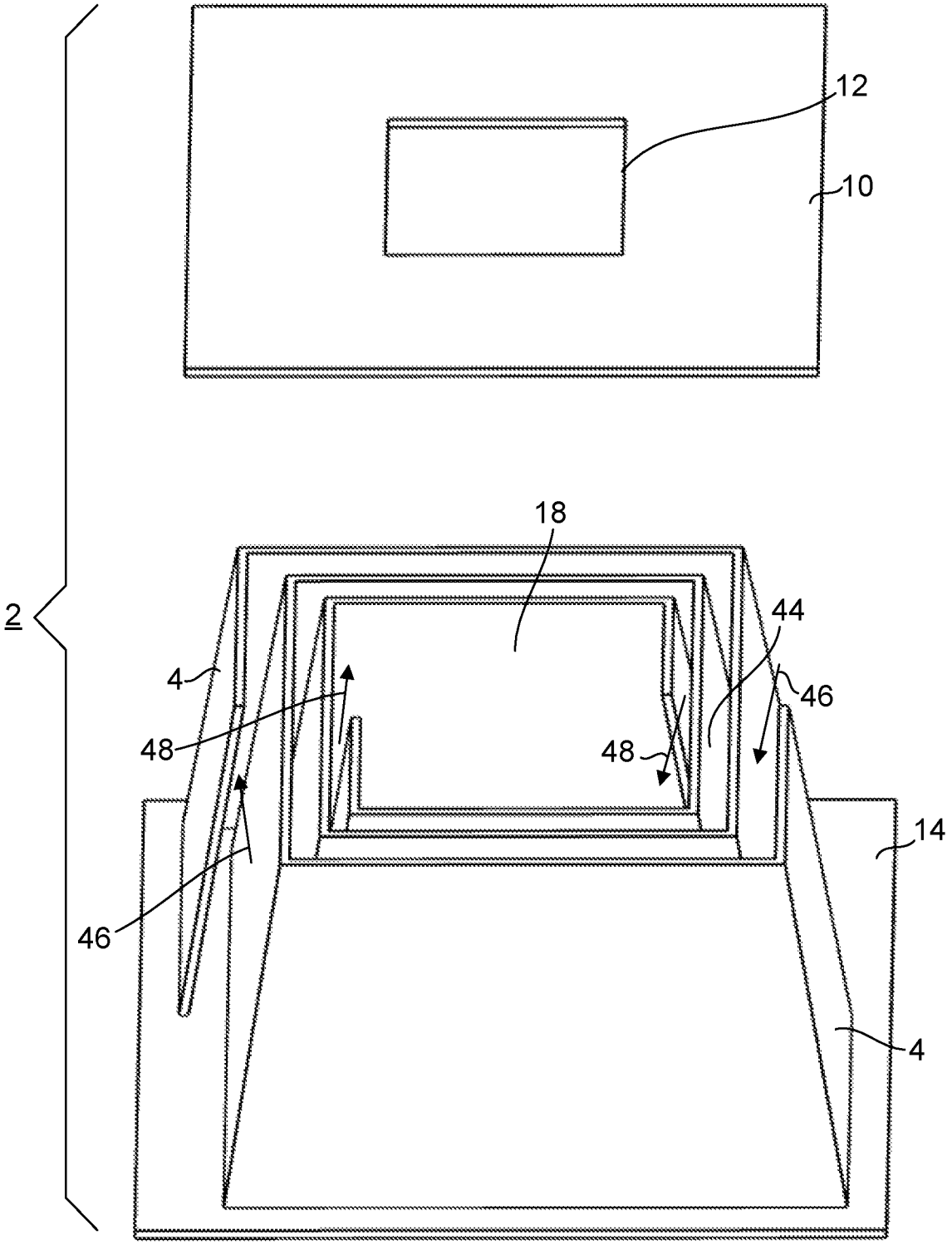
FIG. 12 is a top perspective view of one embodiment of a stove.
Figure 13:
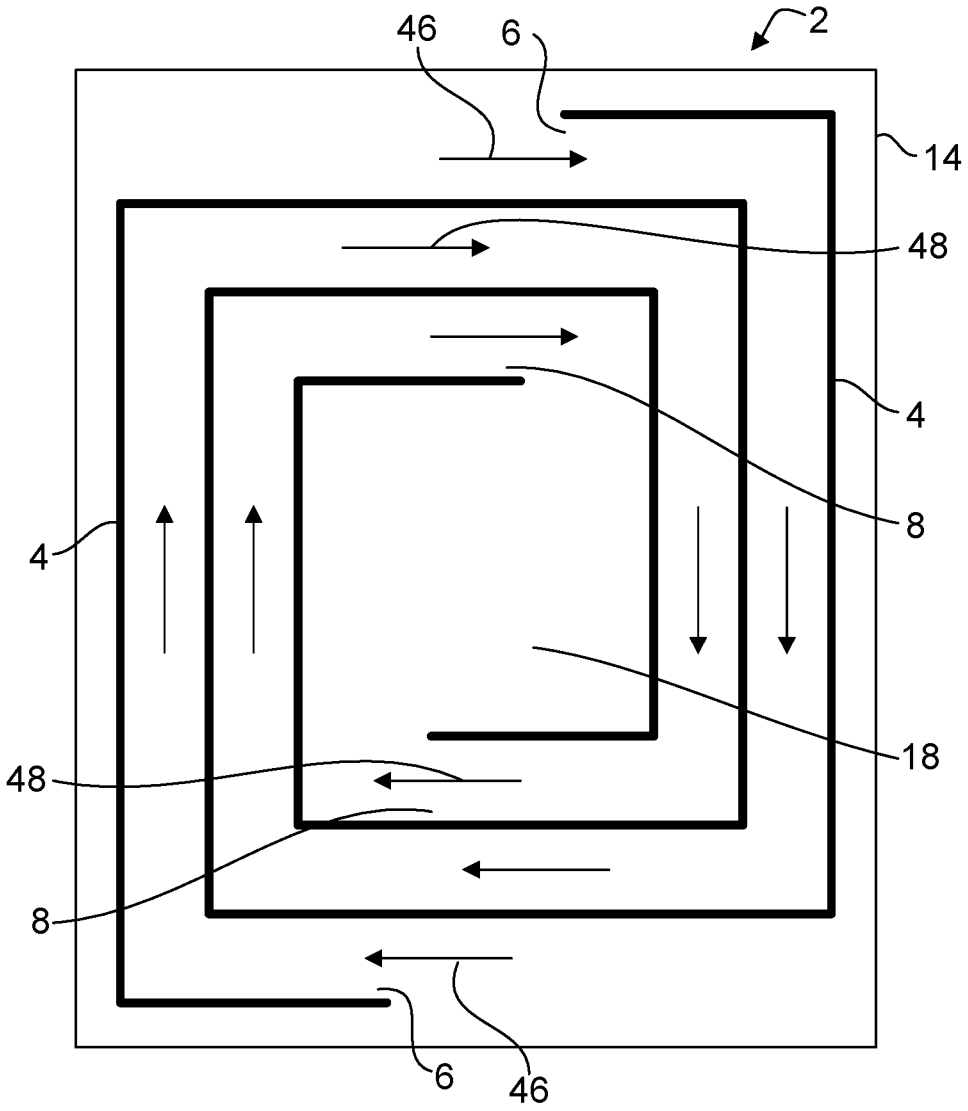
FIG. 13 is a top view of one embodiment of a stove.

FIG. 12 is a top perspective view of one embodiment of a stove 2 with its cover 10 removed to reveal the interior structure of the stove 2. FIG. 13 is a top view of one embodiment of a stove 2. Although a present stove is preferably constructed in a round shape such that an air intake path from the surroundings of the stove to the opening where combustion takes place, is disposed at a distance that gradually decreases, a present stove can be constructed in other shapes, e.g., polygonal shape and dome shapes, provided there exists at least one air intake path that laterally surrounds a centrally-located combustion space. Although less desirably so, due to, among other factors, the less evenly heated intake air through the rectangularly-shaped path/s, the losses experienced both thermally of the intake air and in the intake air pressure, the rectangularly-shaped stove shown in FIGS. 12-13 can function according to the principles of containing heat loss while heating intake air.

Figure 14:
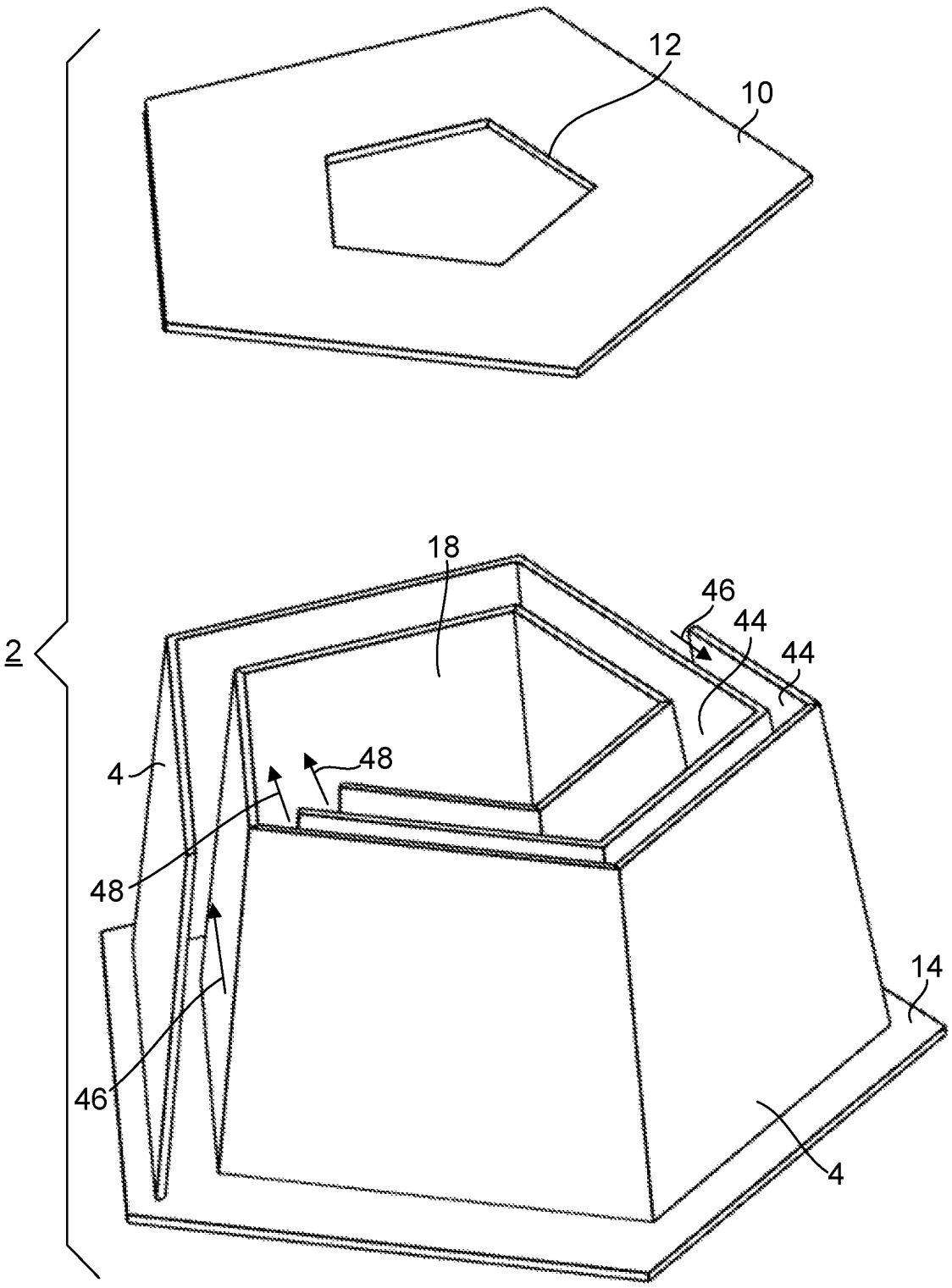
FIG. 14 is a top perspective view of one embodiment of a stove.
Figure 15:
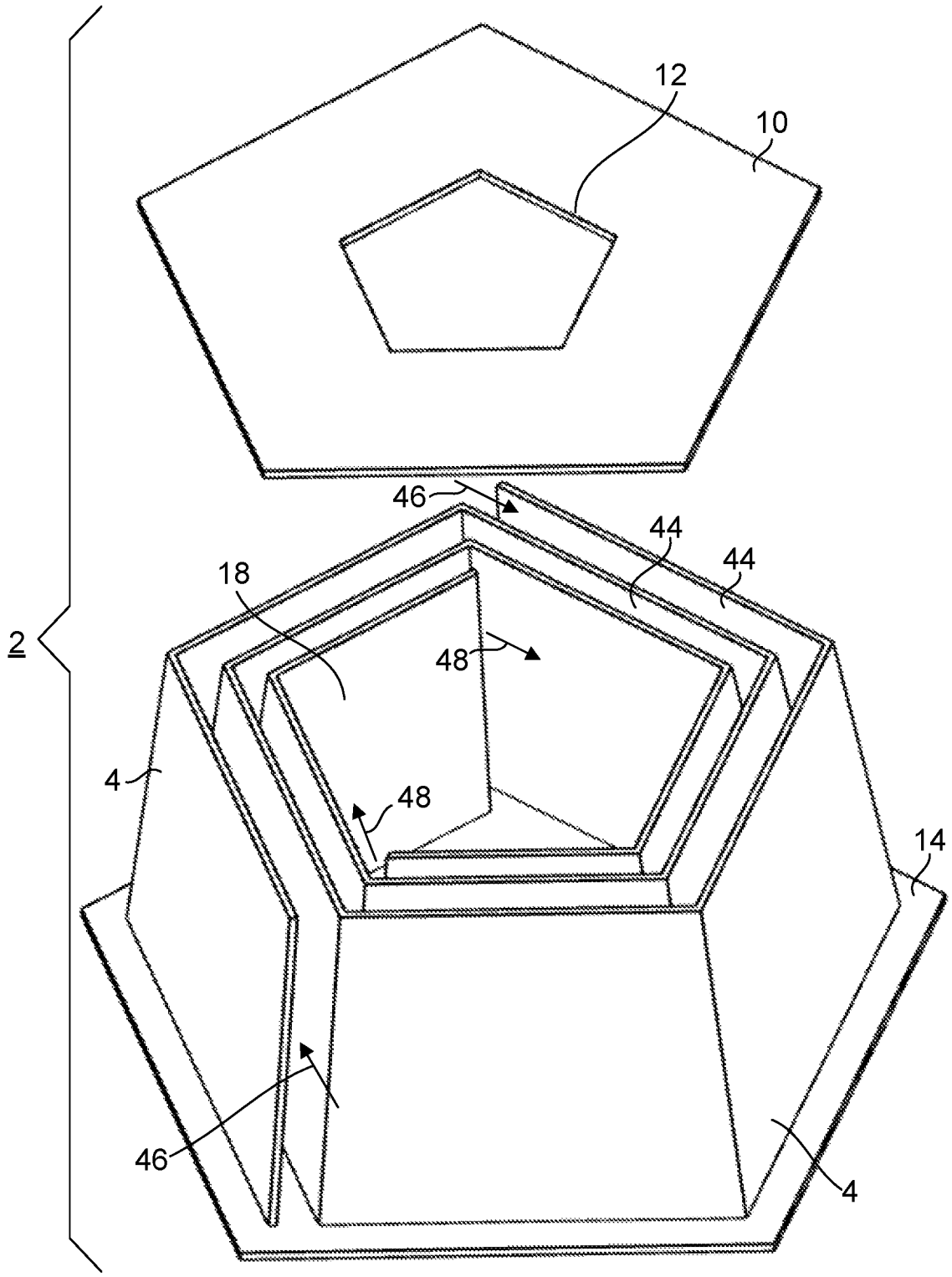
FIG. 15 is a top perspective view of one embodiment of a stove.
Figure 16:
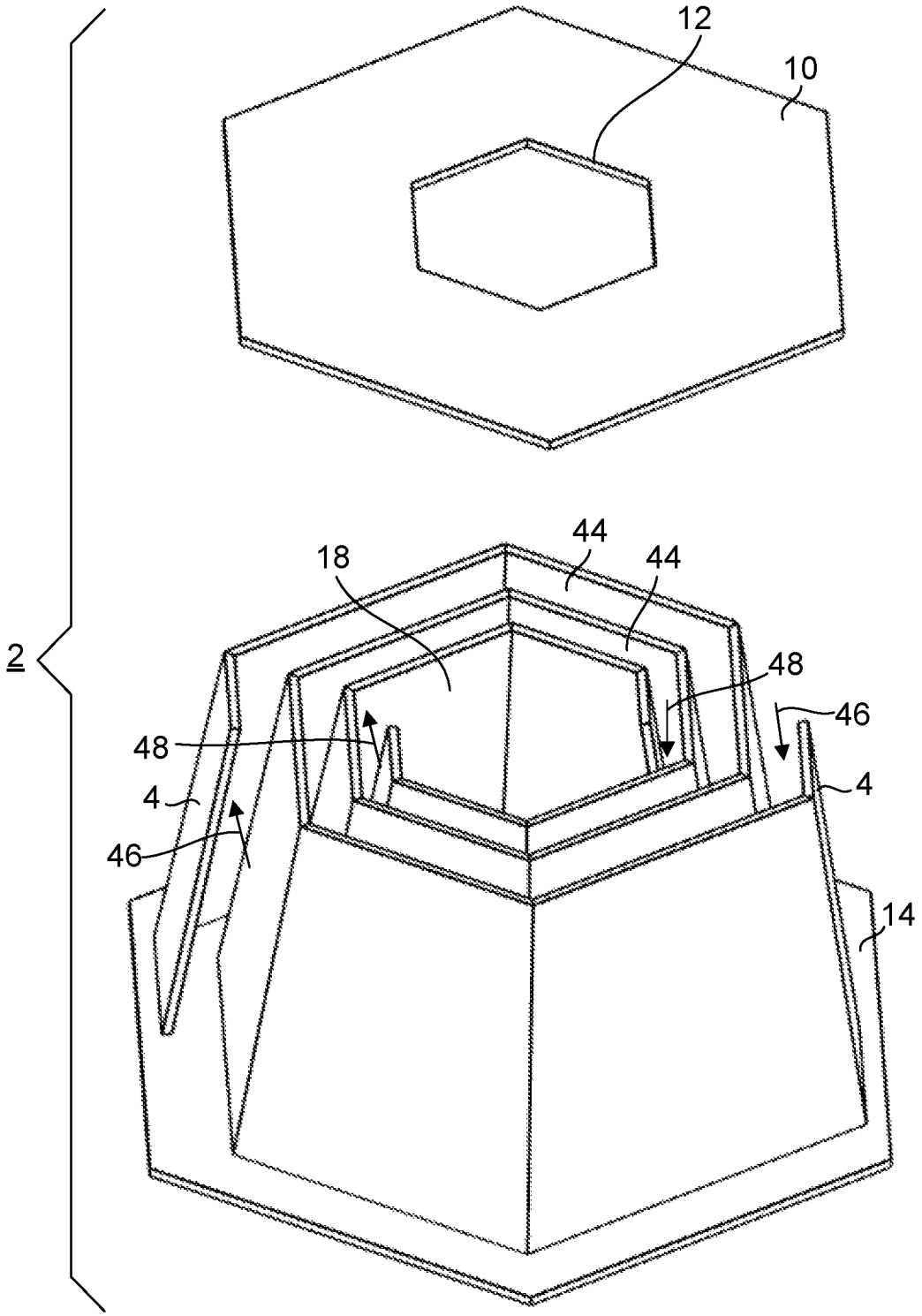
FIG. 16 is a top perspective view of one embodiment of a stove.

FIG. 14 is a top perspective view of one embodiment of a stove 2. FIG. 15 is a top perspective view of one embodiment of a stove 2. Each spiral 4 of FIGS. 14-15 is disposed in the shape of a pentagon. It shall be noted that each spiral 4 shown in FIG. 15 includes a higher number of turns than a spiral 4 shown in FIG. 15, therefore allowing enhanced insulation to the stove shown in FIG. 15. FIG. 16 is a top perspective view of one embodiment of a stove 2. Each spiral 4 of FIG. 16 is disposed in the shape of a hexagon. Again, although less desirably so, due to, among other factors, the less evenly heated intake air through the polygonal-shaped path/s shown in FIGS. 14-16, the losses experienced both thermally of the intake air and in the intake air pressure, the pentagonally-shaped stove shown in FIGS. 14-15 and the hexagonally-shaped stove shown in FIG. 16 can function according to the principles of containing heat loss while getting the intake air heated. It shall also be noted that the spirals 4 shown in FIGS. 12 and 14-16 all incline inwardly about their respective centers or openings 18.

Figure 17:
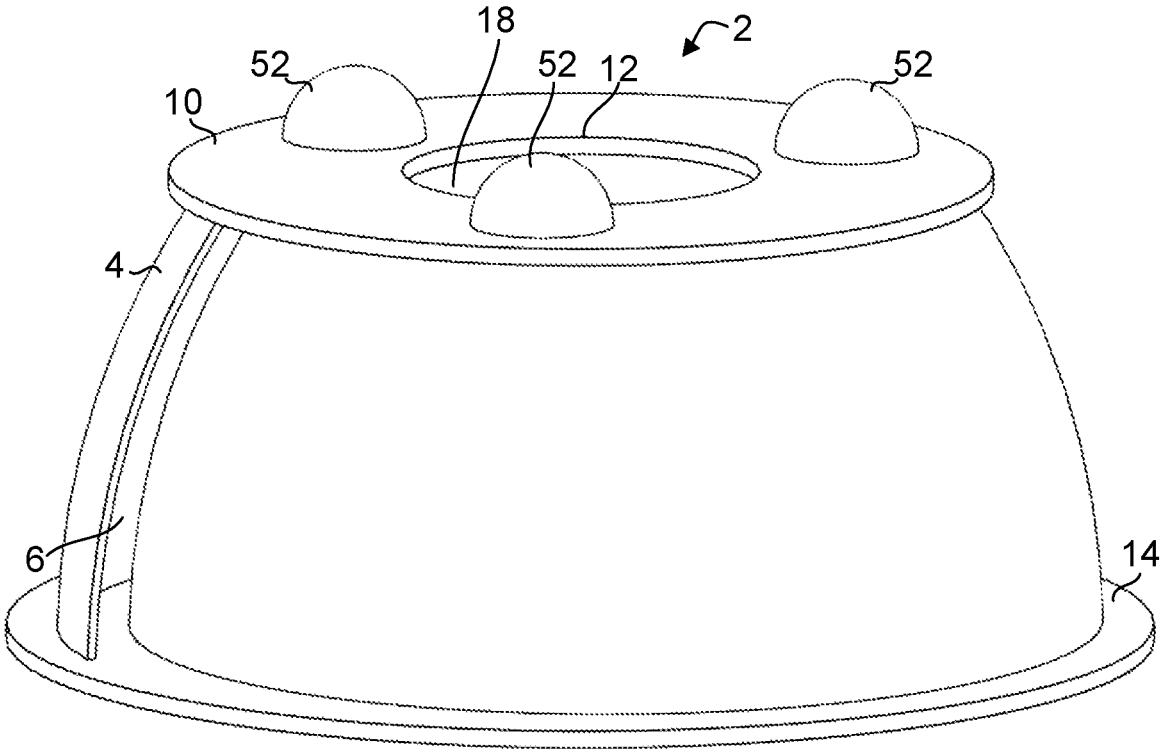
FIG. 17 is a top perspective view of one embodiment of a stove.

FIG. 17 is a top perspective view of one embodiment of a stove 2. Here, the spirals 4 are similar to those found in FIGS. 10-11 with the exception that the spirals 4 curve inwardly as they rise toward the opening 18 of the stove 2 to form a truncated dome and the cover 10 includes a plurality of stand-offs 52 to support a grating that supports, e.g., food while allowing the hot gases of the combustion to penetrate the grating to cook the food disposed thereon.

Figure 18:
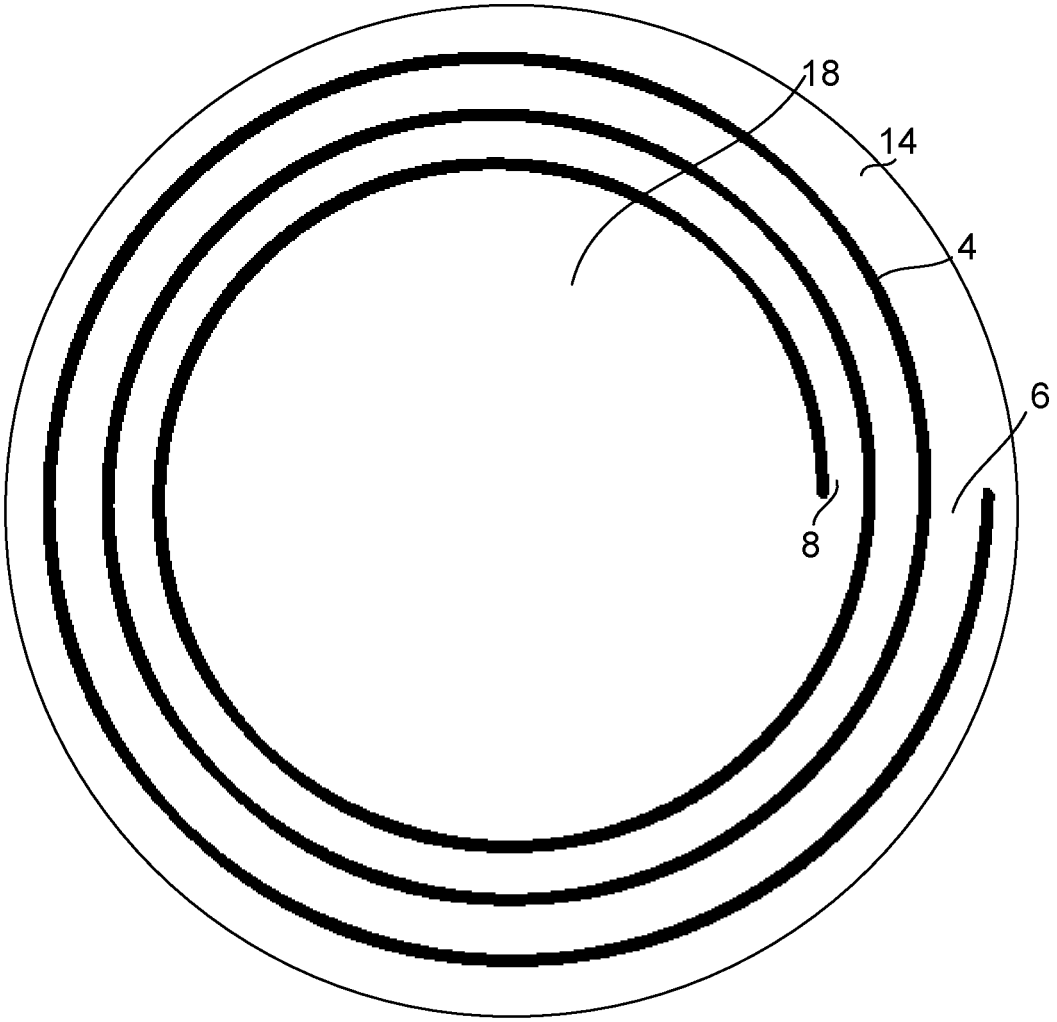
FIG. 18 is a top view of one embodiment of a stove.
Figure 19:
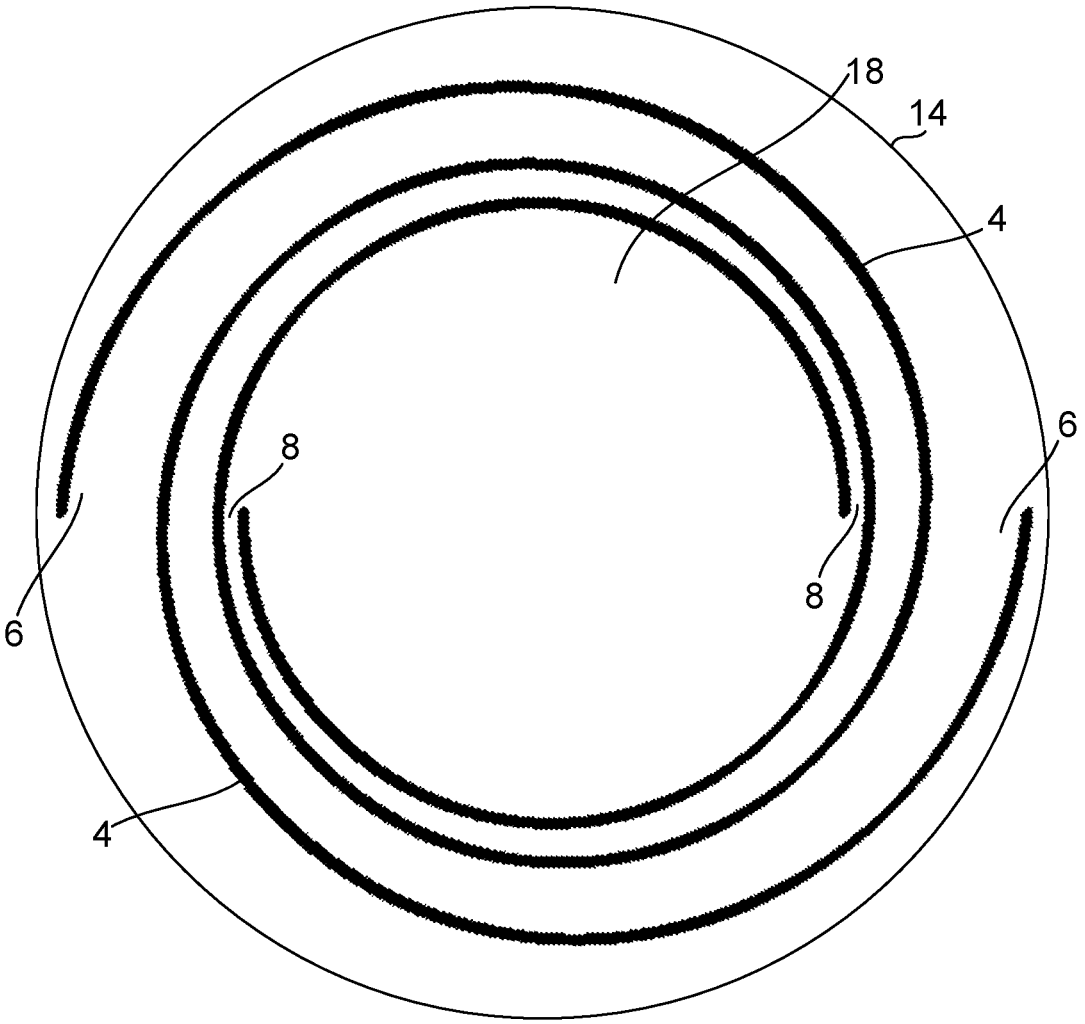
FIG. 19 is a top view of one embodiment of a stove.

The spiraling profile of the spirals disclosed thus far is linear, i.e., the spacing between the successive spiral walls stays constant or a path stays constant in width throughout as the path winds from a starting gap to an ending gap and the spiral profile is said to be linear. In one embodiment, the path narrows as it winds from a starting gap to an ending gap as shown in FIG. 18, causing an air supply to accelerate as it travels through the path from the starting gap to the ending gap, entering an opening to cause more turbulence to increase mixing of the fuel and/or unburnt fuel with air supply to produce combustion at high temperature and "clean" burn. Referring to FIG. 18, it shall be noted that its path narrows as it winds from the starting gap 6 to the ending gap 8. In one embodiment, the narrowing path can be described using an exponential curve or sometimes referred to as a logarithmic profile. In yet another embodiment, the narrowing path can be described using an exponential-polynomial profile as shown in FIG. 19. In yet another embodiment, the narrowing path can be described using a combination of two or more profiles disclosed elsewhere herein.

The spiral wall shown throughout can be constructed from stainless steel, metal, fire refractory material, fireclay refractory material, high alumina refractory material, silica brick, magnesite refractory material, chromite refractory material, zirconia refractory material, insulating material, monolithic refractory material or any combinations thereof.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A stove comprising:

(a) at least one spiral wall configured to wind outwardly a number of turns to form an opening, said at least one spiral wall configured to be disposed in an arrangement to form at least one starting gap between two successive walls formed of said at least one spiral wall at an outer periphery of said at least one spiral wall, said at least one starting gap continues through a path to an ending gap between two successive walls formed of said at least one spiral wall at said opening; and (b) a cover comprising an opening, said cover configured to be disposed atop said at least one spiral wall to contain said path, leaving said opening of said cover to match said opening of said at least one spiral wall, wherein a combustion within said opening of said at least one spiral wall, draws air for combustion through said at least one starting gap, said path and said at least one ending gap into said opening of said at least one spiral wall.

2. The stove of claim 1, wherein said at least one spiral wall is constructed from a material selected from the group consisting of stainless steel, metal, fire refractory material, fireclay refractory material, high alumina refractory material, silica brick, magnesite refractory material, chromite refractory material, zirconia refractory material, insulating material, monolithic refractory material and any combinations thereof.

3. The stove of claim 1, wherein said number of turns of said at least one spiral wall is at least about two turns.

4. The stove of claim 1, wherein said at least one spiral wall is a structure disposed in a round shape, a polygonal shape and a dome shape.

5. The stove of claim 1, wherein said starting gap further comprises a top starting gap and a bottom starting gap and each said ending gap further comprises a top ending gap and a bottom ending gap, wherein said top starting gap is smaller than said bottom starting gap and said top ending gap is smaller than said bottom ending gap.

6. The stove of claim 1, further comprising a base configured to be disposed at the bottom of said at least one spiral wall to further contain said path.

7. The stove of claim 1, wherein said at least one spiral wall comprises a thickness of at least about 1/32 inch.

8. The stove of claim 1, wherein said path comprises a cross-sectional profile having an aspect ratio of about 1/40 to about 1/5.

9. The stove of claim 1, wherein said at least one spiral wall comprises a profile selected from the group consisting of a linear profile, an exponential profile, an exponential-polynomial profile and any combinations thereof.

10. The stove of claim 1, wherein said at least one spiral wall leans inwardly.

11. A stove comprising:

(a) at least two spiral walls, a first spiral wall of said at least two spiral walls configured to wind outwardly a number of turns and a second spiral wall of said at least two spiral walls configured to wind outwardly a number of turns to form an opening together, said at least two spiral walls configured to be disposed in an arrangement to form at least two starting gaps each between two successive walls formed of said at least two spiral walls, each said at least two starting gaps continues through a path to each of at least two ending gaps each between two successive walls formed of said at least two spiral walls; and (b) a cover comprising an opening, said cover configured to be disposed atop said at least two spiral walls to contain said path, leaving said opening of said cover to match said opening of said at least two spiral walls, wherein a combustion within said opening of said at least two spiral walls, draws air for combustion through each said starting gap, each said path and each said ending gap.

12. The stove of claim 11, wherein said at least two spiral walls are each constructed from a material selected from the group consisting of stainless steel, metal, fire refractory material, fireclay refractory material, high alumina refractory material, silica brick, magnesite refractory material, chromite refractory material, zirconia refractory material, insulating material, monolithic refractory material and any combinations thereof.

13. The stove of claim 11, wherein each of said number of turns of said first spiral and said number of turns of said second spiral is at least about two turns.

14. The stove of claim 11, wherein said at least two spiral walls are configured to form a structure selected from a shape consisting of a round shape, a polygonal shape and a dome shape.

15. The stove of claim 11, wherein each said starting gap further comprises a top starting gap and a bottom starting gap and each said ending gap further comprises a top ending gap and a bottom ending gap, wherein each said top starting gap is smaller than each said bottom starting gap and each said top ending gap is smaller than each said bottom ending gap.

16. The stove of claim 11, further comprising a base configured to be disposed at the bottom of said at least two spiral walls to further contain each said path.

17. The stove of claim 11, wherein each said at least two spiral walls comprises a thickness of at least about 1/32 inch.

18. The stove of claim 11, wherein each of said at least two spiral walls comprises a profile selected from the group consisting of a linear profile, an exponential profile, an exponential-polynomial profile and any combinations thereof.

19. The stove of claim 11, wherein each of said at least two spiral walls leans inwardly.

20. The stove of claim 11, wherein said path comprises a cross-sectional profile having an aspect ratio of about 1/40 to about 1/5.

* * * * *